United States Patent [19]

Thompson

[11] Patent Number: 4,916,752

[45] Date of Patent: Apr. 17, 1990

[54] HELICAL VISUAL DISPLAY DEVICE

[76] Inventor: John G. Thompson, P.O. Box 1236, Orange, Va. 22960

[21] Appl. No.: 331,753

[22] Filed: Apr. 3, 1989

[51] Int. Cl.[4] ..... A47F 11/06; B44F 1/00; G09F 19/12

[52] U.S. Cl. ..... 40/427; 272/8 R; 428/8; 428/11

[58] Field of Search ..... 40/427–431, 40/411, 441, 564, 495, 613; 362/806; 428/8, 11; 272/8 R

[56] References Cited

U.S. PATENT DOCUMENTS

| | | | |
|---|---|---|---|
| 640,792 | 1/1900 | Munsell | 40/495 X |
| 741,730 | 10/1903 | Smith | 40/564 X |
| 2,055,910 | 9/1936 | Rasmussen | 40/441 |
| 2,108,002 | 2/1938 | Smith | 40/37 |
| 3,176,265 | 3/1965 | Schweighofer | 40/431 |
| 3,610,624 | 10/1971 | Fleiscker | 273/112 |
| 3,683,843 | 8/1972 | Schlein | 40/427 |
| 4,008,534 | 2/1977 | Swartz | 40/431 |
| 4,214,747 | 6/1980 | Rebajes | 272/8 R |
| 4,437,262 | 3/1984 | Kaga | 46/242 |
| 4,595,369 | 6/1986 | Downs | 434/302 |
| 4,637,941 | 1/1987 | Rochte | 362/806 |

FOREIGN PATENT DOCUMENTS

| | | | |
|---|---|---|---|
| 298561 | 4/1932 | Italy | 40/427 |

*Primary Examiner*—James R. Brittain
*Assistant Examiner*—J. Hakomaki
*Attorney, Agent, or Firm*—Harry Williams

[57] ABSTRACT

A visual display device having two helices each wound from a single tubular-like material about a common axis and one of the helices being within the peripheral confines of the other and the coils of the one helix being wound in the same direction as the wound direction of the coils in the other helix, so that when the device as a whole is rotated the two helices appear to perpetually move in simultaneously opposite directions, thus offering to the viewer of the rotating display device an aesthetically interesting sight.

5 Claims, 2 Drawing Sheets

HELICAL VISUAL DISPLAY DEVICE

BACKGROUND OF THE INVENTION

This invention relates to a visual display device that when rotated combines motion and form in an uncommonly visual manner that is aesthetically pleasing to the viewer.

It is known to have visually pleasing artifacts for use in the home or office, that is, visual display objects which may stand on a desk or hang from a wall or support. There are a number of such visual display devices on the market for use in the home or office which by virtue of their mechanical design and construction can be manipulated by a user to set the same in motion and thereby afford the viewer a pleasing aesthetic effect. Such devices often provide a transparent housing or vessel for containing a colored viscous material which is subjected to motion so that the slow motion of the material itself becomes pleasing to watch.

There is a market, then, for such visual display devices which can offer an interesting visual experience to human perception if both motion and material are combined in a way so as to afford an aesthetically interesting effect to the viewer, especially if such devices are simple in construction and require no moving parts so that when the entire device is rotated as a single unit it can create an unusual aesthetic effect.

OBJECTS AND SUMMARY OF THE INVENTION

It is the primary purpose an principle object of the present invention to provide a rotating visual display device which by virtue of its arrangemnt of materials and combined motion offers to the viewer, that is, to human perception, an aesthetically pleasing sight. The visual display device according to the invention can be used in an office or home environment and can be suspended from above or be supported from below or rolled on its side, and is of such a size and shape that it can be used as a standing article on a desk, or as a visual display hung from the ceiling, or as a toy to be rolled along a surface. In each case the rotary motion imparted to the visual display device according to the invention creates the desired aesthetic effect to the viewer.

According to one embodiment of the invention, the visual display amusement device has two helices, each wound from a single tubular-like material about a common axis. The coils of the one helix are wound in the same direction of the coils in the other helix and are confined within the peripheral confines of the other, as well, so that when the device as a whole is rotated the two helices appear to rotate in simultaneously opposite directions, thus offering to the viewer of the rotating device an aesthetically interesting sight. The shape of the visual display device can be generally cylindrical, conical or a combination of these, and the means from rotating the device can be manual or powered or self-propelled.

The invention will be better understood and further objects and advantages thereof will become more apparent from the ensuing detailed description of the preferred embodiments taking in conjunction with the drawings.

DETAILED DESCRIPTION OF THE INVENTION

Figure 1:
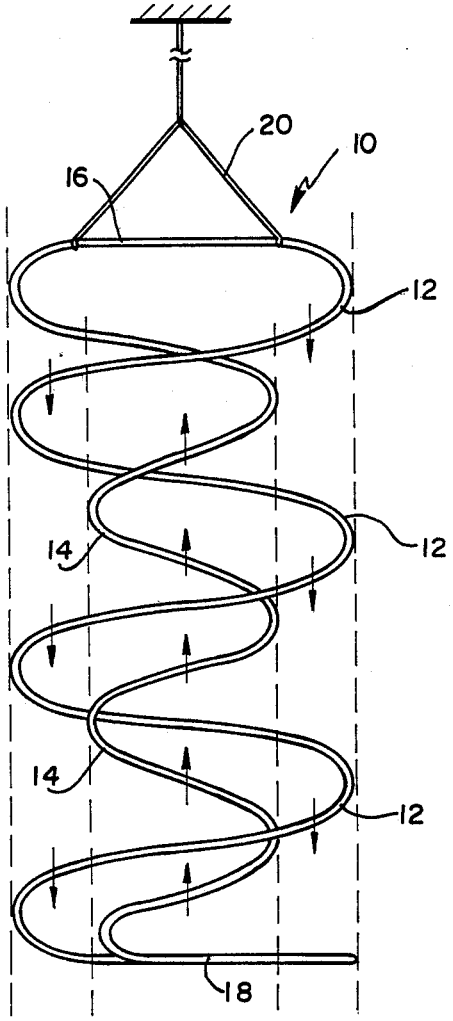
FIG. 1 is schematic plan view of the visual display device according to the present invention.

Referring now to FIG. 1, there is shown the visual display device 10 according to the invention. The device can be formed from a number of different materials, such as metal, alloy, plastic, wood, ceramic, vinyl, fiberglass, or other tubular-like material that is flexible enough for a pair of helices 12, 14 to be formed about a common axis, as shown. Specifically, the helix 12 forms an outside columnar-shaped helix having a top end 16 and a bottom end 18, and the helix 14 forms an inner similarly-shaped but smaller helix that continues the helical pattern—the coils of the one helix being wound in the same direction as the coils of the other—within the peripheral confines of the outer helix 12. The outside dotted lines show the full diametric extent of the outer helix 12, and the inner pair of dotted lines show the full diametric extent of the inner helix 14.

Because the coils of the inner helix 14 are confined with the periphery of the coils in the outer helix 12, the visual display device 10, when rotated, will appear to be moving in simultaneously opposite directions, the inner coils moving in the direction of the arrows shown along the center line of the device, and the outer coils moving in the opposite direction shown by the arrows near the peripheral portions of the device. This uncommon visual effect will be seen to be strikingly attractive in an aesthetic sense. The top end portion 16 of the outer helix 12 is seen to be supported by a suspension wire 20 or the like so that the visual display device 10 can then be rotated at will by means of the user grasping the device and giving it a spin.

The generally cylindrical configuration of the visual display device 10 shown in FIG. 1 facilitates its use as a toy. When used as such the visual display device can be rolled along the floor or other level surface by a child, thus offering to the user of the toy the same visually aesthetic effects as when the visual display device is rotated when suspended, such as shown in FIG. 1.

Figure 2:
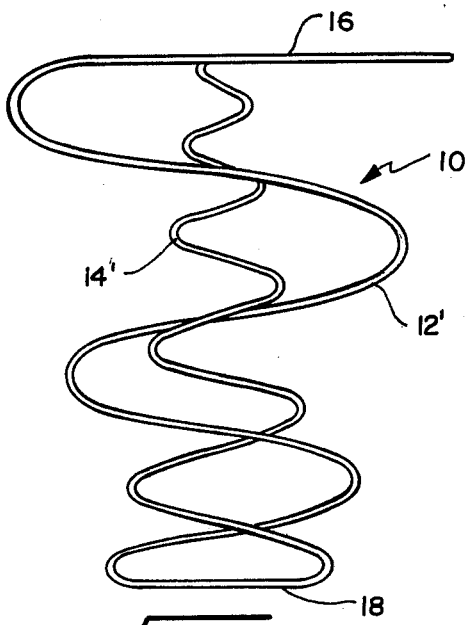
FIG. 2 is a schematic plan view of furhter embodiment of the device shown in FIG. 1.
Figure 3:
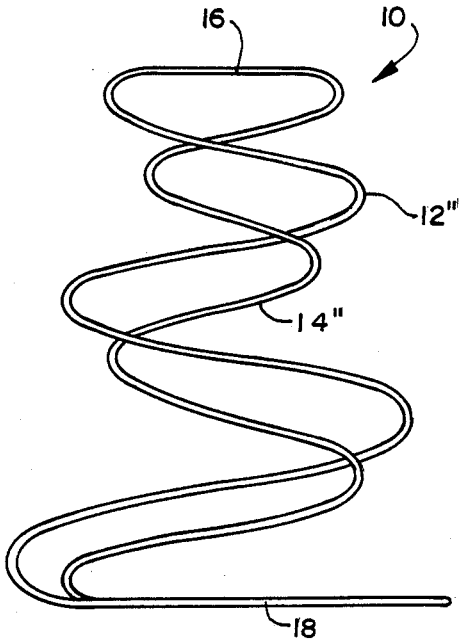
FIG. 3 is a schematic plan view of yet another embodiment of the device shown in FIG. 1.

FIG. 2 shows a further embodiment of the visual display device wherein the inner helix 14 and the outer helix 12 are in the shape of a cone, the one oppositely directed to the other. FIG. 3 shows yet another embodiment where the cone-shaped helices are similarly directed, that is, superimposed.

Figure 4:
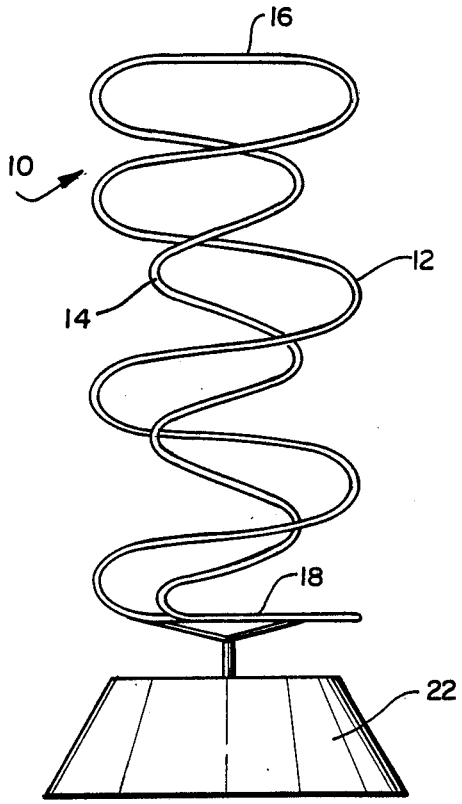
FIG. 4 is schematic plan view of the device shown in FIG. 1 mounted on a rotating support.

FIG. 4 shows the visual display device of FIG. 1 to be supported at the bottom end 18 by a suitable energy source 22, such as a battery powered motor or some such similar rotating support. In this way the visual display device 10 need not be manually propelled but can be rotated for long periods of time at some suitable location.

Figure 5:
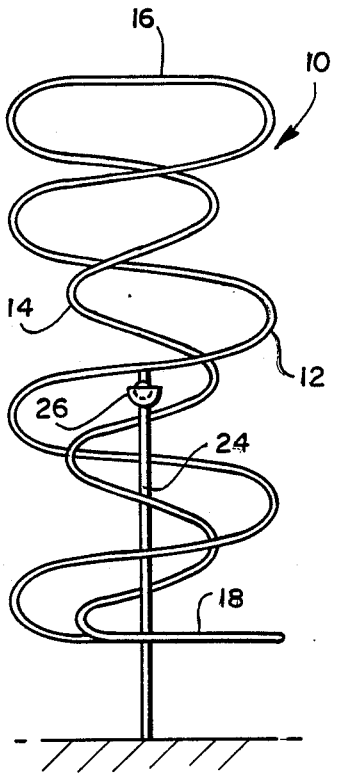
FIG. 5 is a schematic plan view of the device shown in FIG. 1 which is supported at the center of gravity of the device.

FIG. 5 shows the visual display device of FIG. 1 to be supported near its center of gravity by a support member 24 which has a ball and cup connection 26 positioned near one of the inner coils at the center of gravity thereof.

Figure 6:
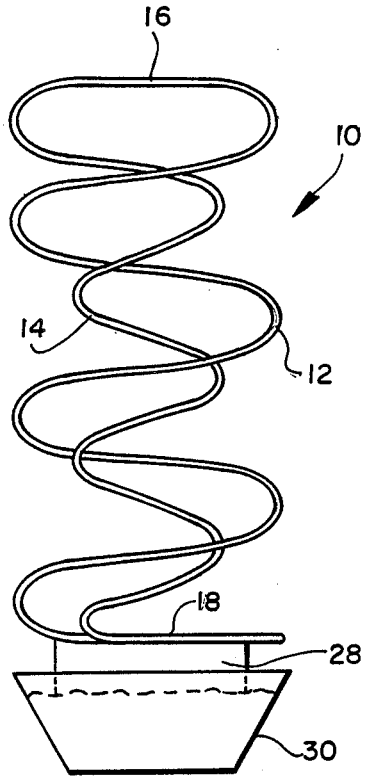
FIG. 6 is schematic plan view of the device shown in FIG. 1 which is supported by means of a float member.

FIG. 6 shows the visual display device of FIG. 1 wherein a float support 28 is provided on the bottom portion 18 of the device 10 so that the same can be supported on a liquid, such as water in a vessel 30. in this way the device 10 can be manually propelled with just a minimum of force. Also, the air currents in a room at times will be sufficent to allow the device 10 to rotate about the liquid surface and thus create the desired aesthetic effect as described above.

Figure 7:
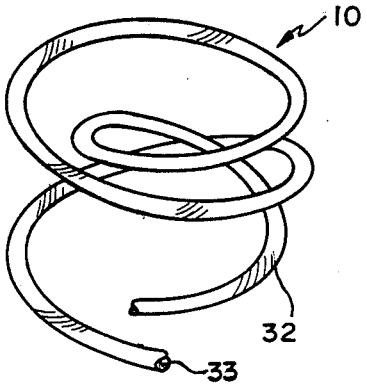
FIG. 7 is schematic perspective of the visual display device according to the invention using a particular kind of tubular material.

FIG. 7 shows a specific tubular-like material composed of a transparent plastic 32 having an inner hollow core portion 33 which may be suitably filled with a colored liquid or the like to enhance the visual effects of the visual display device 10.

Figure 8:
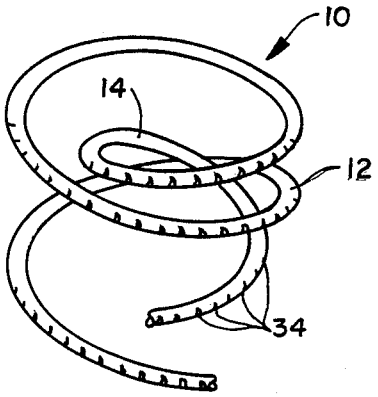
FIG. 8 is schematic perspective of the visual display device according to the invention which is provided with a series of vanes for enhancing rotary manipulation by the wind.

FIG. 8 shows the visual display device 10 to have a series of small vanes eteched or cut into the outside surface of the outer helix 12 in order to allow the device to be used outdoors in the wind. In this way the devcie 10 can be suspended, as shown in FIG. 1, and the vanes 34 will allow the wind to essentially take hold and rotate the visual display device to thereby create the aesthetic effects above described. It is also contemplated that the wind-propelled visual display device according to FIG. 8 could be combined with the embodiment shown in FIG. 6, and the device could then be placed on a surface near an air-vent in a room, or, on the other hand, suspended from a ceiling near an air-vent and so be used indoors as well as outdoors.

The foregoing relates to preferred exemplary embodiments of the present invention, it being understood that other embodiments and variants thereof are possible within the scope of the invention, the latter being defined by the appended claims.

What is claimed and desired to be secured by Letters Patent of the United States is:

1. A visual display device having aesthetic appeal, comprising a single tubular-like material forming an elongated helical structure having a continuous series of helices, a first portion of said helical structure having helices smaller in diameter than the helices of a second remaining portion of said helical structure, said tubular-like material having a transition section between said first portion and said second portion of said helical structure for allowing said first portion of said helical structure to extend within the peripheral confines of the helices of said second portion of said helical structure, and means for rotating said elongated helical structure, whereby said first portion and said second portion of said helical structure rotate as a unit and the helices of said first portion appear to move in the opposite direction to those of said second portion.

2. A visual display device according to claim 1, wherein said rotating means is disposed at said transition section of said helical structure.

3. A visual display device according to claim 1, wherein said rotating means is disposed near the center of gravity of said helical structure on one of the helices of said first portion of said helical structure.

4. A rotating visual display device according to claim 1, wherein said tubular-like material is a continuous endless element.

5. A rotating visual display device, comprising a pair of helices wound from a tubular-like material, said helices having a common longitudinal axis, and the coils of one of said helices being confined within the periphery of the coils of the other helix, whereby said pair of helices appear to be moving in simultaneously opposite directions when said device is rotated, and wherein said tubular-like material is a see-through plastic material having a hollow inner core filled with a colored liquid.

* * * * *